US005967404A

United States Patent [19]

Myles

[11] Patent Number: 5,967,404

[45] Date of Patent: Oct. 19, 1999

[54] HYART-FYLTS LETTER ENVELOPE AND DISPLAY

[76] Inventor: Brindella Myles, 8582 W. Villard Ave., Milwaukee, Wis. 53225

[21] Appl. No.: 08/974,055

[22] Filed: Nov. 19, 1997

[51] Int. Cl.[6] ..... B65D 27/28

[52] U.S. Cl. ..... 229/78.2; 229/75; 229/77; 229/78.1; 229/103.3; 281/35

[58] Field of Search ..... 229/78.2, 92, 92.8, 229/87.01, 125.39, 125.41, 75, 77, 78.1, 79, 103.3, 68.1; 281/29, 35

[56] References Cited

U.S. PATENT DOCUMENTS

| | | | |
|---|---|---|---|
| 284,297 | 9/1883 | Hartwell | 229/92.1 |
| 367,163 | 7/1887 | Rowland | 229/75 |
| 585,816 | 7/1897 | Goodchild | 229/79 |
| 700,352 | 5/1902 | Masters | 229/78.2 |
| 710,684 | 10/1902 | Hanan | 229/78.2 |
| 729,832 | 6/1903 | Allen | 229/79 |
| 754,239 | 3/1904 | Rheutan | 229/78.2 |
| 786,692 | 4/1905 | Stevenot | 229/78.1 |
| 922,934 | 5/1909 | Merrick | 229/78.1 |
| 1,232,610 | 7/1917 | Ryan | 229/78.1 |
| 1,247,099 | 11/1917 | Ferry | 229/78.1 |
| 1,252,848 | 1/1918 | Schleber | 229/78.1 |
| 1,417,790 | 5/1922 | Arntz | 229/78.1 |
| 1,472,647 | 10/1923 | Goodier | 229/79 |
| 1,667,258 | 4/1928 | Hollar, Jr. | 229/79 |
| 2,005,493 | 6/1935 | Blackwell | 229/92.8 |
| 2,108,015 | 2/1938 | Kalish | 281/35 |
| 2,108,343 | 2/1938 | McAllister | 229/75 |
| 2,718,828 | 9/1955 | Buda et al. | 229/75 |
| 2,792,167 | 5/1957 | Sparks | 229/103.3 |
| 3,100,047 | 8/1963 | Wallace | 229/92.8 |
| 4,140,317 | 2/1979 | Ramney | 229/75 |

*Primary Examiner*—Stephen P. Garbe

[57] ABSTRACT

A new hyart-fylts letter envelope and display for providing an alternate form of stationary instead of greeting cards. The inventive device includes an envelope sheet having a display region, and a plurality of flap regions located around the outer perimeter of the display region. A fold line is extended between each flap portion and the display region. The flap regions of the envelope sheet are folded along the fold lines over the inner surface of the envelope sheet such that the display region is substantially covered by flap regions. A plurality of detachably attached writing sheets for writing messages on are located on and coupled to the inner surface of the envelope sheet within the display region such that the plurality of writing sheets are substantially covered by the flap regions when the flap regions are folded over the inner surface of the envelope sheet. The outer surface of the envelope sheet has indicia and images displayed thereon located within the display region of the envelope sheet. A fastener functions as fastening means for fastening the flap regions together when the flap regions of the envelope sheet are folded over the display region of the envelope sheet.

14 Claims, 2 Drawing Sheets

HYART-FYLTS LETTER ENVELOPE AND DISPLAY

BACKGROUND OF THE INVENTION

1. Field of the Invention

The present invention relates to letter envelope and displays and more particularly pertains to a new hyart-fylts letter envelope and display for providing an alternate form of stationary instead of greeting cards.

2. Description of the Prior Art

The use of letter envelope and displays is known in the prior art. More specifically, letter envelope and displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art letter envelope and displays include U.S. Pat. No. 4,167,241; U.S. Pat. No. 5,076,490; U.S. Pat. No. Des. 322,455; U.S. Pat. No. 5,165,726; U.S. Pat. No. 4,706,878; U.S. Pat. No. 3,986,662; and U.S. Pat. No. Des. 285,454.

While these devices fulfill their respective, particular objectives and requirements, the aforementioned patents do not disclose a new hyart-fylts letter envelope and display. The inventive device includes an envelope sheet having a display region, and a plurality of flap regions located around the outer perimeter of the display region. A fold line is extended between each flap portion and the display region. The flap regions of the envelope sheet are folded along the fold lines over the inner surface of the envelope sheet such that the display region is substantially covered by flap regions. A plurality of detachably attached writing sheets for writing messages on are located on and coupled to the inner surface of the envelope sheet within the display region such that the plurality of writing sheets are substantially covered by the flap regions when the flap regions are folded over the inner surface of the envelope sheet. The outer surface of the envelope sheet has indicia and images displayed thereon located within the display region of the envelope sheet. A fastener functions as fastening means for fastening the flap regions together when the flap regions of the envelope sheet are folded over the display region of the envelope sheet.

In these respects, the hyart-fylts letter envelope and display according to the present invention substantially departs from the conventional concepts and designs of the prior art, and in so doing provides an apparatus primarily developed for the purpose of providing an alternate form of stationary instead of greeting cards.

SUMMARY OF THE INVENTION

In view of the foregoing disadvantages inherent in the known types of letter envelope and displays now present in the prior art, the present invention provides a new hyart-fylts letter envelope and display construction wherein the same can be utilized for providing an alternate form of stationary instead of greeting cards.

The general purpose of the present invention, which will be described subsequently in greater detail, is to provide a new hyart-fylts letter envelope and display apparatus and method which has many of the advantages of the letter envelope and displays mentioned heretofore and many novel features that result in a new hyart-fylts letter envelope and display which is not anticipated, rendered obvious, suggested, or even implied by any of the prior art letter envelope and displays, either alone or in any combination thereof.

To attain this, the present invention generally comprises an envelope sheet having a display region, and a plurality of flap regions located around the outer perimeter of the display region. A fold line is extended between each flap portion and the display region. The flap regions of the envelope sheet are folded along the fold lines over the inner surface of the envelope sheet such that the display region is substantially covered by flap regions. A plurality of detachably attached writing sheets for writing messages on are located on and coupled to the inner surface of the envelope sheet within the display region such that the plurality of writing sheets are substantially covered by the flap regions when the flap regions are folded over the inner surface of the envelope sheet. The outer surface of the envelope sheet has indicia and images displayed thereon located within the display region of the envelope sheet. A fastener functions as fastening means for fastening the flap regions together when the flap regions of the envelope sheet are folded over the display region of the envelope sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hyart-fylts letter envelope and display apparatus and method which has many of the advantages of the letter envelope and displays mentioned heretofore and many novel features that result in a new hyart-fylts letter envelope and display which is not anticipated, rendered obvious, suggested, or even implied by any of the prior art letter envelope and displays, either alone or in any combination thereof.

It is another object of the present invention to provide a new hyart-fylts letter envelope and display which may be easily and efficiently manufactured and marketed.

It is a further object of the present invention to provide a new hyart-fylts letter envelope and display which is of a durable and reliable construction.

An even further object of the present invention is to provide a new hyart-fylts letter envelope and display which is susceptible of a low cost of manufacture with regard to both materials and labor, and which accordingly is then susceptible of low prices of sale to the consuming public, thereby making such hyart-fylts letter envelope and display economically available to the buying public.

Still yet another object of the present invention is to provide a new hyart-fylts letter envelope and display which provides in the apparatuses and methods of the prior art some of the advantages thereof, while simultaneously overcoming some of the disadvantages normally associated therewith.

Still another object of the present invention is to provide a new hyart-fylts letter envelope and display for providing an alternate form of stationary instead of greeting cards.

Yet another object of the present invention is to provide a new hyart-fylts letter envelope and display which includes an envelope sheet having a display region, and a plurality of flap regions located around the outer perimeter of the display region. A fold line is extended between each flap portion and the display region. The flap regions of the envelope sheet are folded along the fold lines over the inner surface of the envelope sheet such that the display region is substantially covered by flap regions. A plurality of detachably attached writing sheets for writing messages on are located on and coupled to the inner surface of the envelope sheet within the display region such that the plurality of writing sheets are substantially covered by the flap regions when the flap regions are folded over the inner surface of the envelope sheet. The outer surface of the envelope sheet has indicia and images displayed thereon located within the display region of the envelope sheet. A fastener functions as fastening means for fastening the flap regions together when the flap regions of the envelope sheet are folded over the display region of the envelope sheet.

Still yet another object of the present invention is to provide a new hyart-fylts letter envelope and display that may have a envelope sheet formed into various shapes such as rectangles, hearts, circles and stars.

Even still another object of the present invention is to provide a new hyart-fylts letter envelope and display that may be constructed from various materials and colors and have different displayed images according to the desired message wishing to be conveyed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
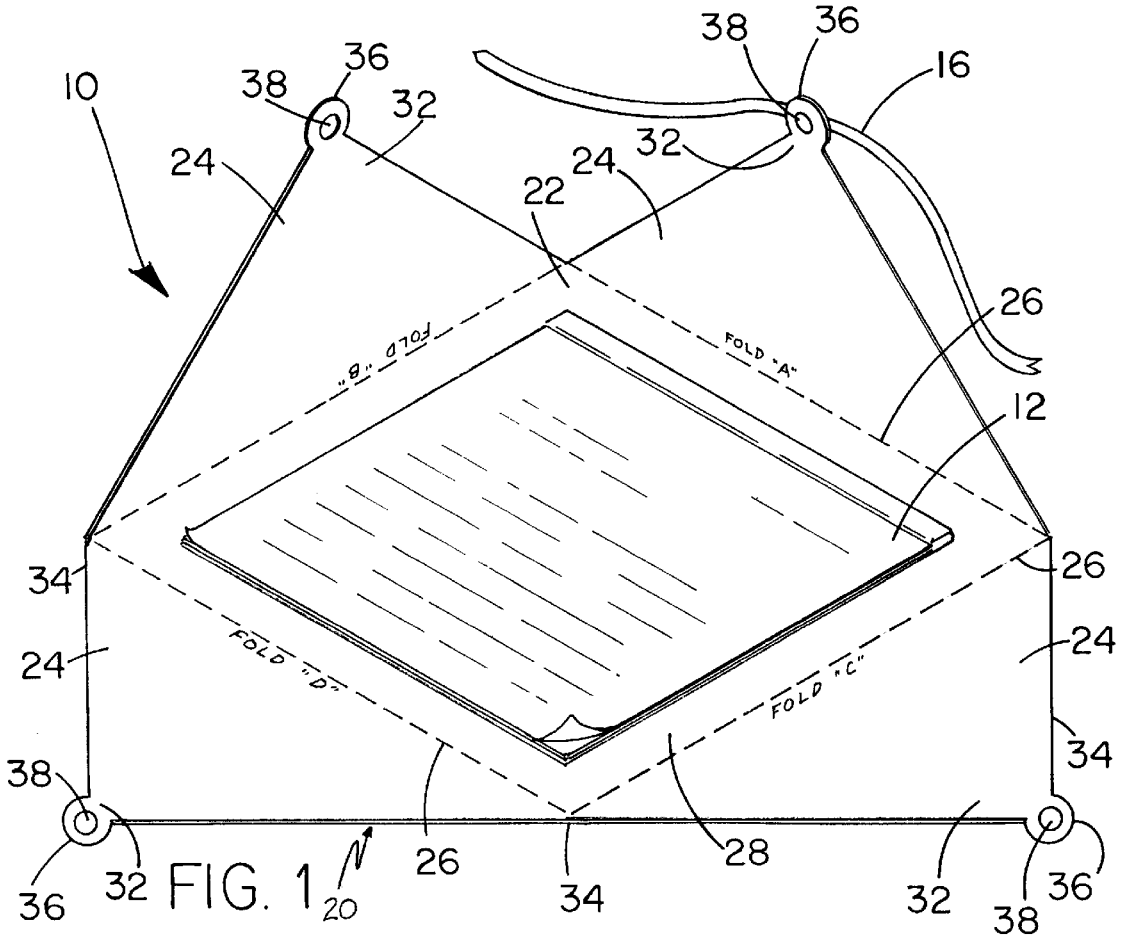
FIG. 1 is a schematic perspective view of a new hyart-fylts letter envelope and display according to the present invention.
Figure 2:
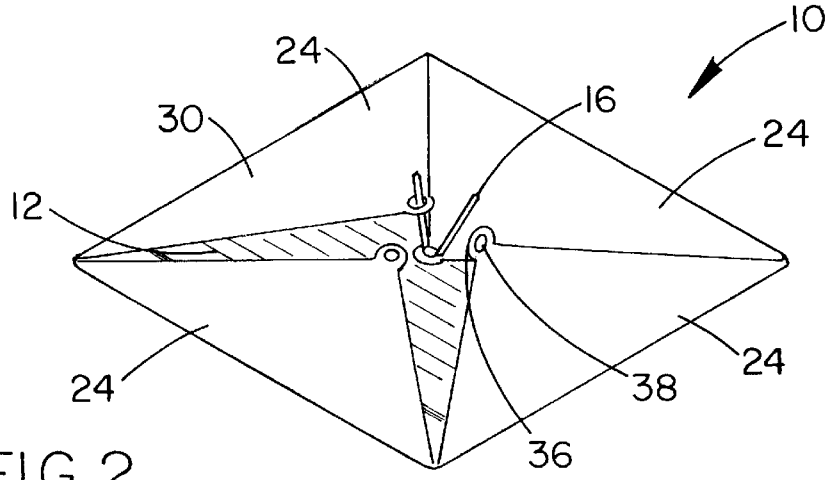
FIG. 2 is a schematic perspective view of the present invention with the flap portions folded over the display portion.

With reference now to the drawings, and in particular to FIGS. 1 through 5 thereof, a new hyart-fylts letter envelope and display embodying the principles and concepts of the present invention and generally designated by the reference numeral 10 will be described.

As best illustrated in FIGS. 1 through 5, the hyart-fylts letter envelope and display 10 generally comprises an envelope sheet 20 having a display region 22, and a plurality of flap regions 24 located around the outer perimeter of the display region 22. A fold line 26 is extended between each flap portion 24 and the display region 22. The flap regions 24 of the envelope sheet 20 are folded along the fold lines 26 over the inner surface 28 of the envelope sheet 20 such that the display region 22 is substantially covered by flap regions 24. A plurality of detachably attached writing sheets 12 for writing messages on are located on and coupled to the inner surface 28 of the envelope sheet 20 within the display region 22 such that the plurality of writing sheets 12 are substantially covered by the flap regions 24 when the flap regions 24 are folded over the inner surface 28 of the envelope sheet 20. The outer surface 30 of the envelope sheet 20 has indicia and images 14 displayed thereon located within the display region 22 of the envelope sheet 20. A fastener 16 functions as fastening means for fastening the flap regions 24 together when the flap regions 24 of the envelope sheet 20 are folded over the display region 22 of the envelope sheet 20.

Figure 3:
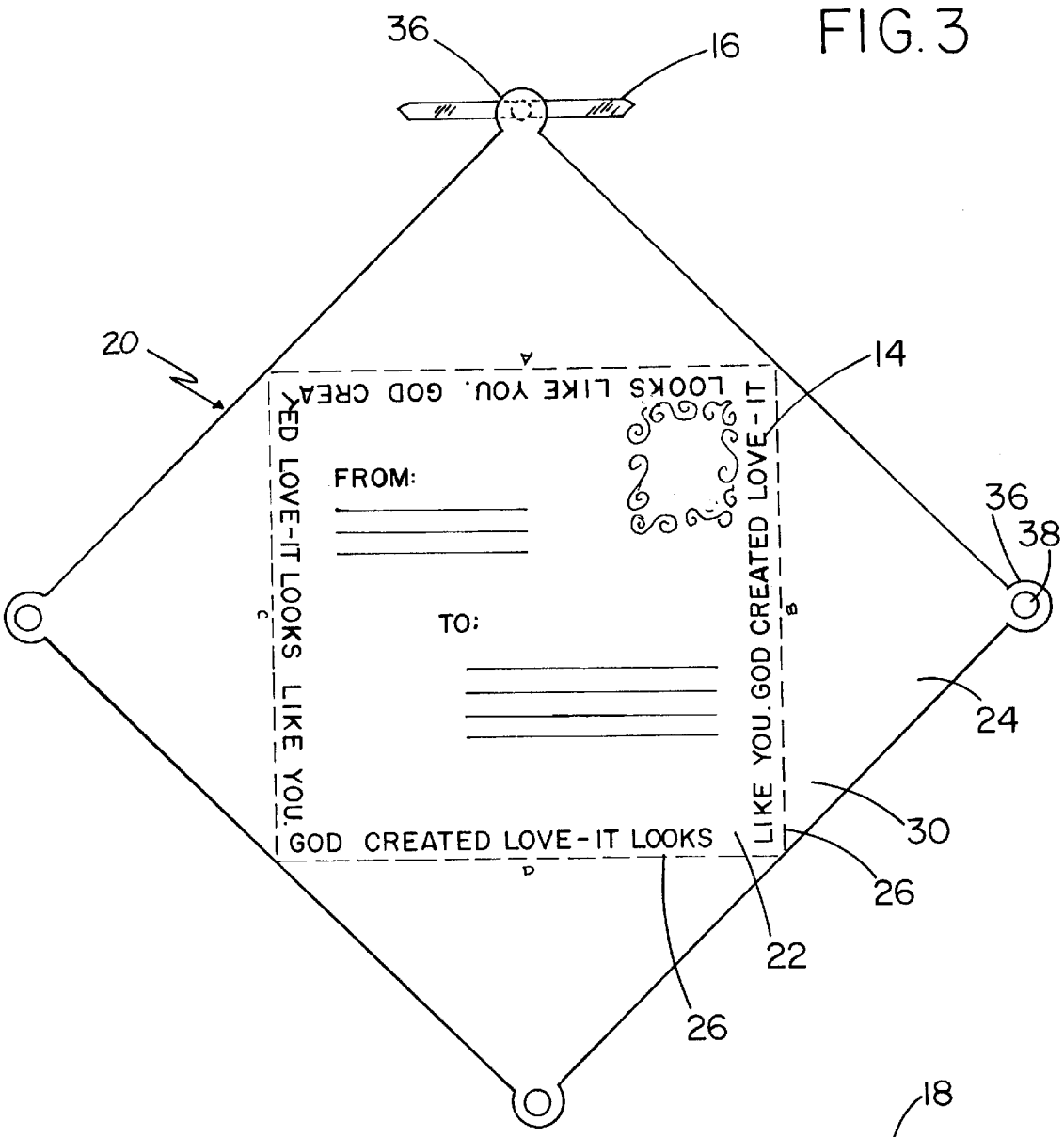
FIG. 3 is a schematic side view of the outer side of the present invention.

With reference to FIGS. 1 and 3, the envelope sheet is preferably rectangular and has inner and outer surfaces 28,30, four corners 32, and four sides 34. A fold line 26 is extended between each pair of adjacent sides of the envelope sheet 20 so that the fold lines 26 define the display region 22 therebetween on the envelope sheet 20. Each of the flap regions 24 is defined between each corner 32 and its adjacent fold line 26. The flap regions 24 may be folded along the fold lines 26 over the inner surface 28 of the envelope sheet 20 such that the display region 22 is substantially covered by flap regions 24.

Figure 4:
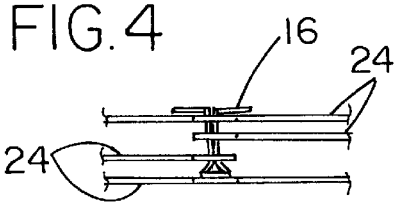
FIG. 4 is a schematic side view the fastener and the fastening tabs of the present invention when folded.
Figure 5:
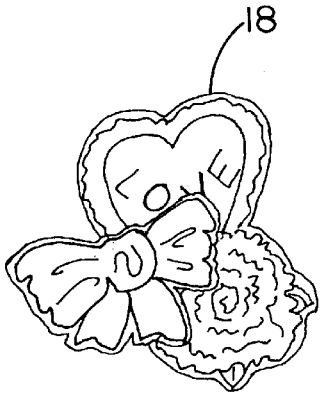
FIG. 5 is a schematic side view of the sticker member of the present invention.

The corners 32 of the envelope sheet 20 are fastenable by fastening means 16 when the flap regions 24 of the envelope sheet 20 are folded over the display region 22 of the envelope sheet 20. Preferably, extending from each corner 32 of the envelope sheet 20 is a fastening tab 36. Each fastening tab 36 has a hole that is substantially coaxially alignable with the holes in the other tabs when the flap regions 24 are folded over the display region 22. An elongate flexible fastener 16, such as a flexible clasp (as shown in FIGS. 3 and 4) or a string or ribbon (as shown in FIG. 1) is extendable through the holes 38 of the fastening tabs 36 when the flap regions 24 are folded over the display region 22 to serve as a fastening means. Ideally, the fastening means also includes a sticker member 18 for adhesively coupling the flap regions 24 when the flap regions 24 are folded over the display region 22.

The invention may also include plurality of detachably attached writing sheets 12 located on and coupled to the inner surface 28 of the envelope sheet 20 within the display region 22 such that the plurality of writing sheets 12 are substantially covered by the flap regions 24 when the flap regions 24 are folded over the inner surface 28 of the envelope sheet 20. Optionally, one edge of each writing sheets is staggered with the corresponding edges of the other writing sheets.

With reference to FIG. 3, the outer surface 30 has indicia and images 14 displayed thereon located ideally located within the display region 22 of the envelope sheet 20. The indicia and images 14 may vary depending on the desired message wishing to be conveyed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A letter envelope and display, comprising:

a rectangular envelope sheet having an inner surface, an outer surface, four corners, and four sides;

said envelope sheet having a fold line being extended between each pair of adjacent sides of said envelope sheet, said fold lines defining a display region therebetween on said envelope sheet, a flap region being defined between each said corner of said envelope sheet and its adjacent said fold line, said flap regions of said envelope sheet being folded along said fold lines over said inner surface of said envelope sheet such that said display region is substantially covered by flap regions; and fastening means for fastening said corners of said envelope sheet when said flap regions of said envelope sheet are folded over said display region of said envelope sheet;

wherein each said corner of said envelope sheet has a fastening tab being extended therefrom, said fastening means fastening said fastening tabs together when said flap regions are folded over said display region.

2. The letter envelope and display of claim 1, wherein each said fastening tab has a hole being extended therethrough, said holes of said fastening tabs being substantially coaxially alignable with each other when said flap regions are folded over said display region, wherein said fastening means includes an elongate flexible fastener being extendable through said holes of said fastening tabs when said flap regions of said envelope sheet are folded over said display region of said envelope sheet.

3. The letter envelope and display of claim 1, wherein said fastening means includes a sticker member for adhesively coupling said flap regions when said flap regions of said envelope sheet are folded over said display region of said envelope sheet.

4. The letter envelope and display of claim 1, further comprising a plurality of detachably attached writing sheets being located on said inner surface of said envelope sheet within said display region such that said plurality of writing sheets within said display region are substantially covered by said flap regions when said flap regions are folded over said inner surface of said envelope sheet.

5. The letter envelope and display of claim 4, wherein said plurality of detachably attached writing sheets are coupled to said inner surface of said envelope sheet.

6. The letter envelope and display of claim 1, wherein said outer surface having indicia and images displayed thereon.

7. The letter envelope and display of claim 6, wherein said outer surface indicia and images are located within said display region of said envelope sheet.

8. A letter envelope and display, comprising:

a rectangular envelope sheet having an inner surface, an outer surface, four corners, and four sides;

said envelope sheet having a fold line being extended between each pair of adjacent sides of said envelope sheet, said fold lines defining a display region therebetween on said envelope sheet, a flap region being defined between each said corner of said envelope sheet and its adjacent said fold line, said flap regions of said envelope sheet being folded along said fold lines over said inner surface of said envelope sheet such that said display region is substantially covered by flap regions;

each said corner of said envelope sheet having a fastening tab being extended therefrom, each said fastening tab having a hole being extended therethrough, said holes of said fastening tabs being substantially coaxially alignable with each other when said flap regions are folded over said display region;

a plurality of detachably attached writing sheets being located on said inner surface of said envelope sheet within said display region such that said plurality of writing sheets within said display region are substantially covered by said flap regions when said flap regions are folded over said inner surface of said envelope sheet, said plurality of detachably attached writing sheets being coupled to said inner surface of said envelope sheet, wherein one edge of each said writing sheets is staggered with the corresponding edge of said other writing sheets;

said outer surface having indicia and images displayed thereon located within said display region of said envelope sheet; and fastening means for fastening said corners of said envelope sheet when said flap regions of said envelope sheet are folded over said display region of said envelope sheet, wherein said fastening means includes an elongate flexible fastener being extendable through said holes of said fastening tabs when said flap regions of said envelope sheet are folded over said display region of said envelope sheet, wherein said fastening means includes a sticker member for adhesively coupling said flap regions when said flap regions of said envelope sheet are folded over said display region of said envelope sheet.

9. A letter envelope and display, comprising:

an envelope sheet having an inner surface, an outer surface;

said envelope sheet having a plurality of flap regions and a display region, said flap regions being located around the outer perimeter of said display region;

a fold line being extended between each flap portion and said display region, said flap regions of said envelope sheet being folded along said fold lines over said inner surface of said envelope sheet such that said display region is substantially covered by flap regions;

a plurality of detachably attached writing sheets being located on said inner surface of said envelope sheet within said display region such that said plurality of writing sheets within said display region are substantially covered by said flap regions when said flap regions are folded over said inner surface of said envelope sheet, said plurality of detachably attached writing sheets being coupled to said inner surface of said envelope sheet;

said outer surface having indicia and images displayed thereon located within said display region of said envelope sheet; and fastening means for fastening said flap regions of said envelope sheet when said flap regions of said envelope sheet are folded over said display region of said envelope sheet.

10. A letter envelope and display, comprising:

a rectangular envelope sheet having an inner surface, an outer surface, four corners, and four sides;

said envelope sheet having a fold line being extended between each pair of adjacent sides of said envelope sheet, said fold lines defining a display region therebetween on said envelope sheet, a flap region being defined between each said corner of said envelope sheet and its adjacent said fold line, said flap regions of said envelope sheet being folded along said fold lines over said inner surface of said envelope sheet such that said display region is substantially covered by flap regions;

fastening means for fastening said corners of said envelope sheet when said flap regions of said envelope sheet are folded over said display region of said envelope sheet; and a plurality of detachably attached writing sheets being located on said inner surface of said envelope sheet within said display region such that said plurality of writing sheets within said display region are substantially covered by said flap regions when said flap regions are folded over said inner surface of said envelope sheet.

11. The letter envelope and display of claim 10, wherein said fastening means includes a sticker member for adhesively coupling said flap regions when said flap regions of said envelope sheet are folded over said display region of said envelope sheet.

12. The letter envelope and display of claim 10, wherein said plurality of detachably attached writing sheets are coupled to said inner surface of said envelope sheet.

13. The letter envelope and display of claim 10, wherein said outer surface having indicia and images displayed thereon.

14. The letter envelope and display of claim 13, wherein said outer surface indicia and images are located within said display region of said envelope sheet.

* * * * *